US009726386B2

(12) United States Patent
Billman et al.

(10) Patent No.: US 9,726,386 B2
(45) Date of Patent: Aug. 8, 2017

(54) AIR CONDITIONER UNIT INCLUDING A HEATING UNIT

(71) Applicant: General Electric Company, Schenectady, NY (US)

(72) Inventors: David William Billman, Louisville, KY (US); Wilbur Carl Bewley, Jr., Nicholasville, KY (US); Robert William Jewell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 430 days.

(21) Appl. No.: 14/468,783

(22) Filed: Aug. 26, 2014

(65) Prior Publication Data

US 2016/0061464 A1 Mar. 3, 2016

(51) Int. Cl.

| | |
|---|---|
| ***F24F 7/00*** | (2006.01) |
| ***F25B 29/00*** | (2006.01) |
| ***F28F 7/00*** | (2006.01) |
| ***A61H 33/12*** | (2006.01) |
| ***D06F 75/00*** | (2006.01) |
| ***F17C 7/04*** | (2006.01) |

(Continued)

(52) U.S. Cl.

CPC ..... *F24F 1/022* (2013.01); *F24F 13/30* (2013.01); *F24F 2221/34* (2013.01); *F28F 2275/14* (2013.01); *F28F 2280/00* (2013.01)

(58) Field of Classification Search

CPC .... F24F 13/27; F24F 13/30; F24F 1/02; F24F 1/027; F28F 2280/00; F28F 2280/04; F28F 2275/14

USPC ..... 392/406, 455; 219/523, 536, 542; 165/48.1, 74, 78, 59; 180/68.4

See application file for complete search history.

(56) References Cited

U.S. PATENT DOCUMENTS 5,372,189 A * 12/1994 Tsunekawa ..... F24F 1/027 165/59
5,895,597 A * 4/1999 Sherrill ..... H05B 3/16 219/532

(Continued)

FOREIGN PATENT DOCUMENTS

JP 07063405 A 3/1995
JP 20120052728 A 3/1995

(Continued)

*Primary Examiner* — Len Tran
*Assistant Examiner* — Paul Alvare
(74) *Attorney, Agent, or Firm* — Dority & Manning, P.A.

(57) ABSTRACT

In accordance with one embodiment, an air conditioner unit is provided. The air conditioner unit includes a heater housing having peripheral surfaces defining a housing interior, the peripheral surfaces including a first sidewall and a second sidewall spaced apart along the lateral direction. The air conditioner unit further includes a guide track extending along the lateral direction between the first sidewall and the second sidewall. The air conditioner unit further includes a blower fan, the blower fan including a blade assembly disposed within the interior and a motor connected to the blade assembly. The air conditioner unit further includes a heating unit comprising a first bracket and a second bracket spaced apart along the lateral direction. The heating unit further includes at least one heater bank extending along the lateral direction between the first bracket and the second bracket. The heating unit is movable along the guide track.

20 Claims, 6 Drawing Sheets

(51) Int. Cl.

| | |
|---|---|
| ***F24H 1/20*** | (2006.01) |
| ***H05B 3/78*** | (2006.01) |
| ***H05B 3/06*** | (2006.01) |
| ***F24F 1/02*** | (2011.01) |
| *F24F 13/30* | (2006.01) |

(56) References Cited

U.S. PATENT DOCUMENTS

| | | | | |
|---|---|---|---|---|
| 6,020,577 | A * | 2/2000 | Barker | H01C 1/012 219/536 |
| 6,315,257 | B1 * | 11/2001 | Fennesz | F24D 19/04 248/209 |
| 7,911,776 | B2 | 3/2011 | Ikeda et al. | |
| 2003/0029184 | A1 * | 2/2003 | Ohama | F24F 13/06 62/262 |
| 2010/0212861 | A1 | 8/2010 | Setsu et al. | |

FOREIGN PATENT DOCUMENTS

| | | | |
|---|---|---|---|
| JP | 07-233996 | | 9/1995 |
| JP | 07286746 | A | 10/1995 |
| JP | 2004190900 | A | 7/2004 |
| JP | 2009 024966 | A | 2/2009 |

* cited by examiner

AIR CONDITIONER UNIT INCLUDING A HEATING UNIT

FIELD OF THE INVENTION

The present disclosure relates generally to air conditioner units, and more particularly to apparatus for assembling and disassembling heating units thereof in the air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for cooling the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room. The heating unit of a conventional air conditioner unit is typically formed from a ceramic plate or a plurality of coils, which may for example be formed from nichrome. In many known arrangements of air conditioner units, the heating unit is positioned along a transverse direction in front of the blower fan, such that the heating unit is not vertically aligned with the blower fan along the transverse direction. This facilitates removal of the heating unit as required for, for example, maintenance and replacement, by allowing the heating unit to be removed along a vertical direction without being blocked by the blower fan.

However, in some air conditioner units, the heating unit may be blocked from such vertical removal. For example, in air conditioner units which utilize heater coils arranged in one or two columns, the thickness of the overall heater unit may prevent vertical removal due to being blocked by the blower fan. In other words, at least a portion of the heating unit may be vertically aligned with the blower fan along the transverse direction. The conventional approach to removing such heater units is to disassemble a number of components of the air conditioner unit, including the blower fan, to access and remove the heater unit. This is a cumbersome and inefficient approach.

Accordingly, improved air conditioner units are desired. In particular, air conditioner units which facilitate easy and efficient removal and replacement of heating units thereof would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an air conditioner unit is provided. The air conditioner unit defines a vertical direction, a lateral direction, and a transverse direction that are each perpendicular to each other. The air conditioner unit includes a heater housing having peripheral surfaces defining a housing interior, the peripheral surfaces including a first sidewall and a second sidewall, the first and second sidewalls spaced apart along the lateral direction. The air conditioner unit further includes a guide track extending along the lateral direction between the first sidewall and the second sidewall. The air conditioner unit further includes a blower fan, the blower fan including a blade assembly disposed within the interior and a motor connected to the blade assembly. The air conditioner unit further includes a heating unit comprising a first bracket and a second bracket, the first and second brackets spaced apart along the lateral direction. The heating unit further includes at least one heater bank extending along the lateral direction between the first bracket and the second bracket. The heating unit is movable along the guide track.

In accordance with another embodiment, an air conditioner unit is provided. The air conditioner unit defines a vertical direction, a lateral direction, and a transverse direction that are each perpendicular to each other. The air conditioner unit includes a heater housing having peripheral surfaces defining a housing interior, the peripheral surfaces including a first sidewall and a second sidewall, the first and second sidewalls spaced apart along the lateral direction. The heater housing includes a bulkhead and a shroud connected to the bulkhead, the bulkhead and shroud comprising the peripheral surfaces, the shroud further comprising an interior shroud base. The air conditioner unit further includes a guide track extending along the lateral direction between the first sidewall and the second sidewall. The air conditioner unit further includes a blower fan, the blower fan including a blade assembly disposed within the interior and a motor connected to the blade assembly. The air conditioner unit further includes a heating unit comprising a first bracket and a second bracket, the first and second brackets spaced apart along the lateral direction. At least one of the first bracket and the second bracket includes a mating guide feature matable with the guide track. The heating unit further includes a plurality of heater banks each extending along the lateral direction between the first bracket and the second bracket. The heating unit is movable along the guide track.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
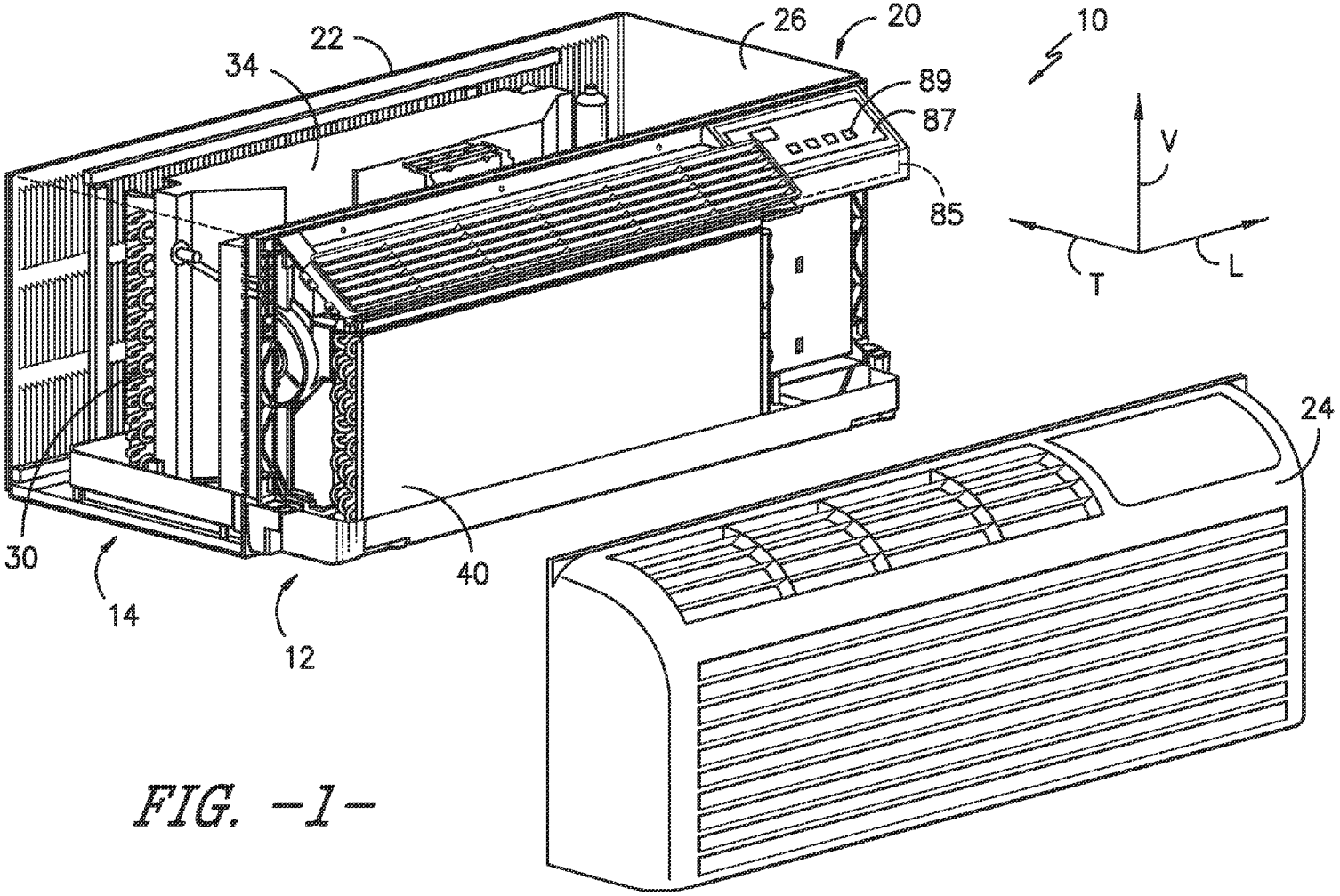
FIG. 1 provides a perspective view of an air conditioner unit, with a room front exploded from a remainder of the air conditioner unit for illustrative purposes, in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner. The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction by a wall sleeve 26. The rear grill 22 may be part of the outdoor portion 14, which the room front 24 is part of the indoor portion 12. Components of the outdoor portion 14, such as an outdoor heat exchanger 30, outdoor fan (not shown), and compressor (not shown) may be housed within the wall sleeve 26. A casing 34 may additionally enclose the outdoor fan, as shown.

Referring now also to FIGS. 2 through 5, indoor portion 12 may include, for example, an indoor heat exchanger 40, a blower fan 42, and a heating unit 44. These components may, for example, be housed behind the room front 24. Additionally, a heater housing 46 may generally support and/or house various other components or portions thereof of the indoor portion 12, such as the blower fan 42 and the heating unit 44.

Heater housing 46 may have peripheral surfaces 50 that define a housing interior 51. For example, the peripheral surfaces 50 may include a first sidewall 52 and a second sidewall 54 which are spaced apart along the lateral direction L. Peripheral surfaces 50 may additionally include a base pan 56 and an outlet air diverter 58, each of which may extend between the sidewalls 52, 54 along the lateral direction L.

The housing 46 may be formed from one or more components. For example, in exemplary embodiments, the housing 46 may be formed from a bulkhead 60 and a shroud 62. The bulkhead 60 may in some embodiments be formed from a suitable plastic, or alternatively may be formed from any suitable material. The shroud 62 may in some embodiments be formed from a suitable metal, or alternatively may be formed from any suitable material. The shroud 62 may be connected to the bulkhead 60, and the bulkhead 60 and shroud 62 may together include the peripheral surfaces 50. For example, base pan 56 and outlet air diverter 58 may be components of the bulkhead 60, and portions of or entire sidewalls 52, 54 may be components of the shroud 62. Shroud 62 may additionally include an interior shroud base 64, which may for example be disposed within interior 51 adjacent base pan 56.

In exemplary embodiments, blower fan 42 may be a tangential fan. Alternatively, however, any suitable fan type may be utilized. Blower fan 42 may include a blade assembly 70 and a motor 72. The blade assembly 70, which may include one or more blades disposed within a fan housing 74, may be disposed within the interior 51 of the heater housing 46. As shown, blade assembly 70 may for example extend along the lateral direction L between the first sidewall 52 and the second sidewall 54. The motor 72 may be connected to the blade assembly 70, such as through the housing 74 to the blades via a shaft. Operation of the motor 72 may rotate the blades, thus generally operating the blower fan 42. Further, in exemplary embodiments, motor 72 may be disposed exterior to the heater housing 46. Accordingly, the shaft may for example extend through one of the sidewalls 52, 54 to connect the motor 72 and blade assembly 70.

Referring now to FIGS. 2 through 6, heating unit 44 in exemplary embodiments includes one or more heater banks 80. Each heater bank 80 may be individually powered, separately from other heater banks 80, to provide heat. In exemplary embodiments, three heater banks 80 may be utilized. Further, each heater bank 80 may in some embodiments have a different rated power level. For example in some embodiments, a heating unit 44 may include a 1000 Watt bank 80, a 1400 Watt bank 80, and a 2400 Watt bank 80. Each heater bank 80 may further include at least one heater coil or coil pass 82, such as in exemplary embodiments two heater coils or coil passes 82. As show, in exemplary embodiments multiple heater banks 80 may be stacked vertically, and the coils 82 of a heater bank 80 may be arranged side-by-side. Accordingly, in exemplary embodiments wherein each heater bank 80 has two heater coils 82 the coils 82 may be arranged in two columns and three rows as shown.

The operation of air conditioner unit 10 including blower fan 42, heater banks 80, heating coils 82 thereof, and other suitable components may be controlled by a processing device such as a controller 85. Controller 85 may be in communication (via for example a suitable wired or wireless connection) to such components of the air conditioner unit 10. By way of example, the controller 85 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 85 may additionally include a control panel 87 and one or more user inputs 89, which may be included in control panel 87. The user inputs 89 may be in communication with the controller 85. A user of the unit 10 may interact with the user inputs 89 to operate the unit 10, and user commands may be transmitted between the user inputs 89 and controller 85 to facilitate operation of the unit 10 based on such user commands.

Figure 2:
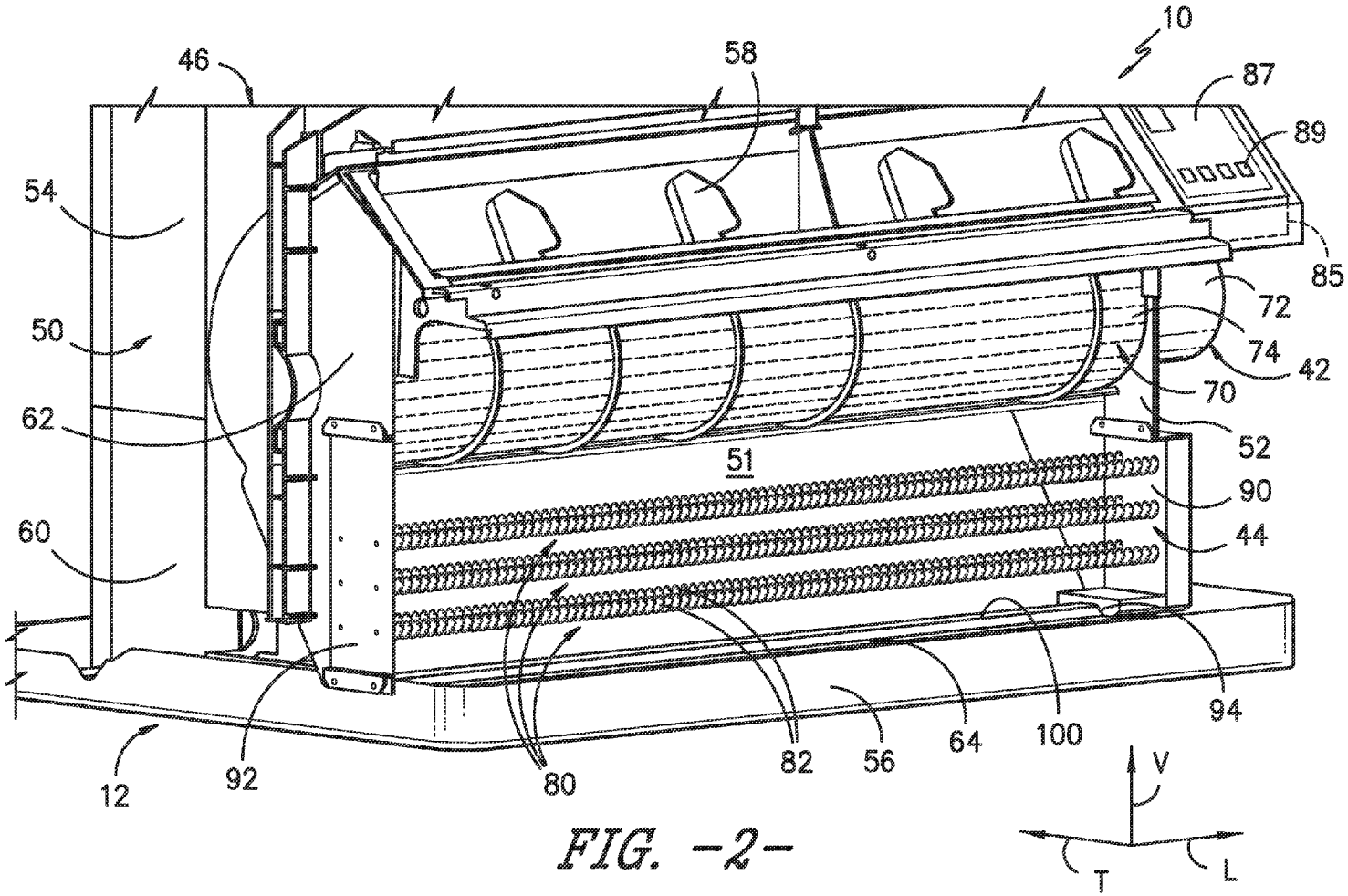
FIG. 2 is a perspective view of components of an indoor portion of an air conditioner unit, with a heating unit in an assembled position, in accordance with one embodiment of the present disclosure.
Figure 3:
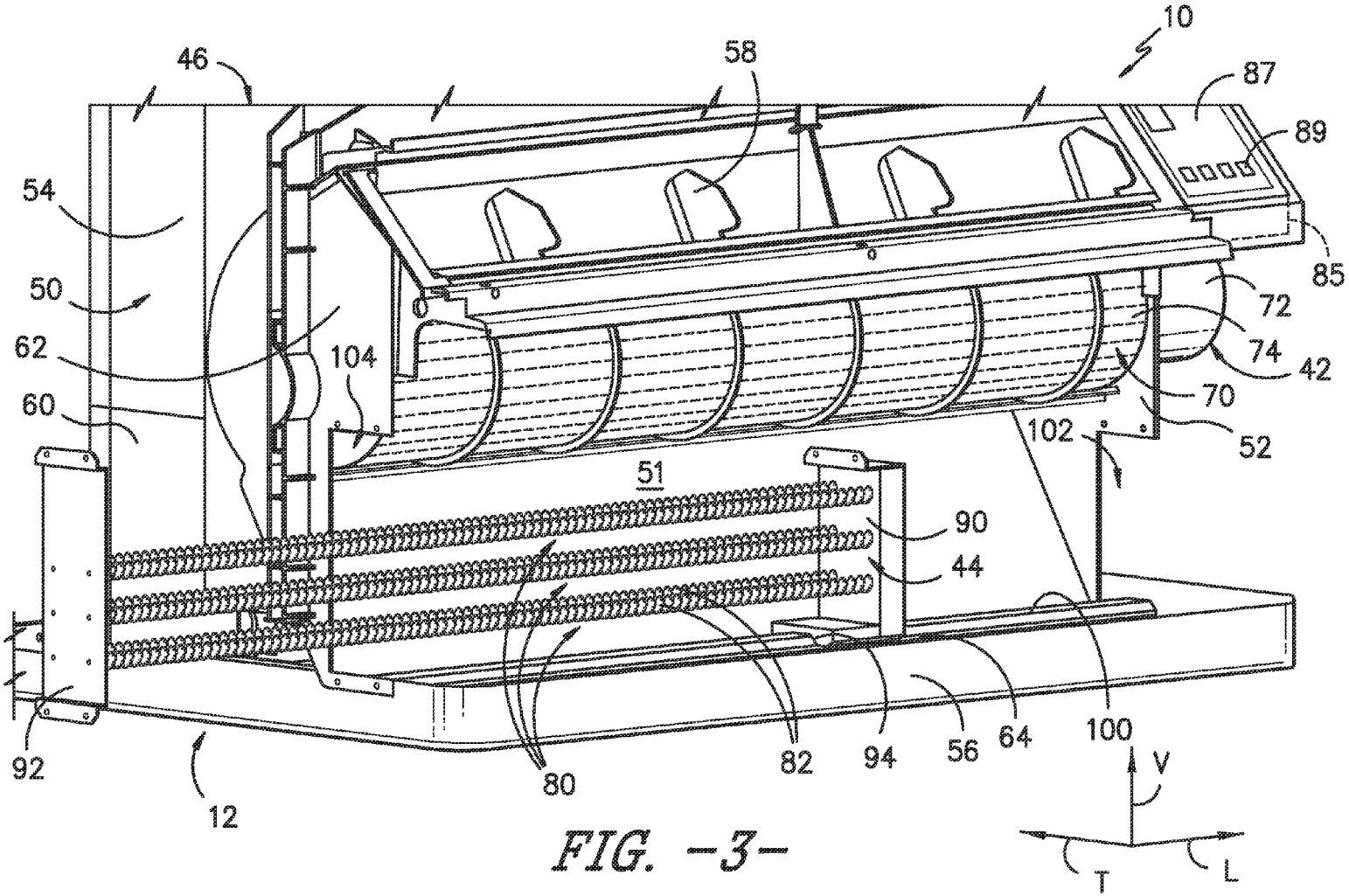
FIG. 3 is a perspective view of components of an indoor portion of an air conditioner unit, with a heating unit in a disassembled position, in accordance with one embodiment of the present disclosure.
Figure 4:
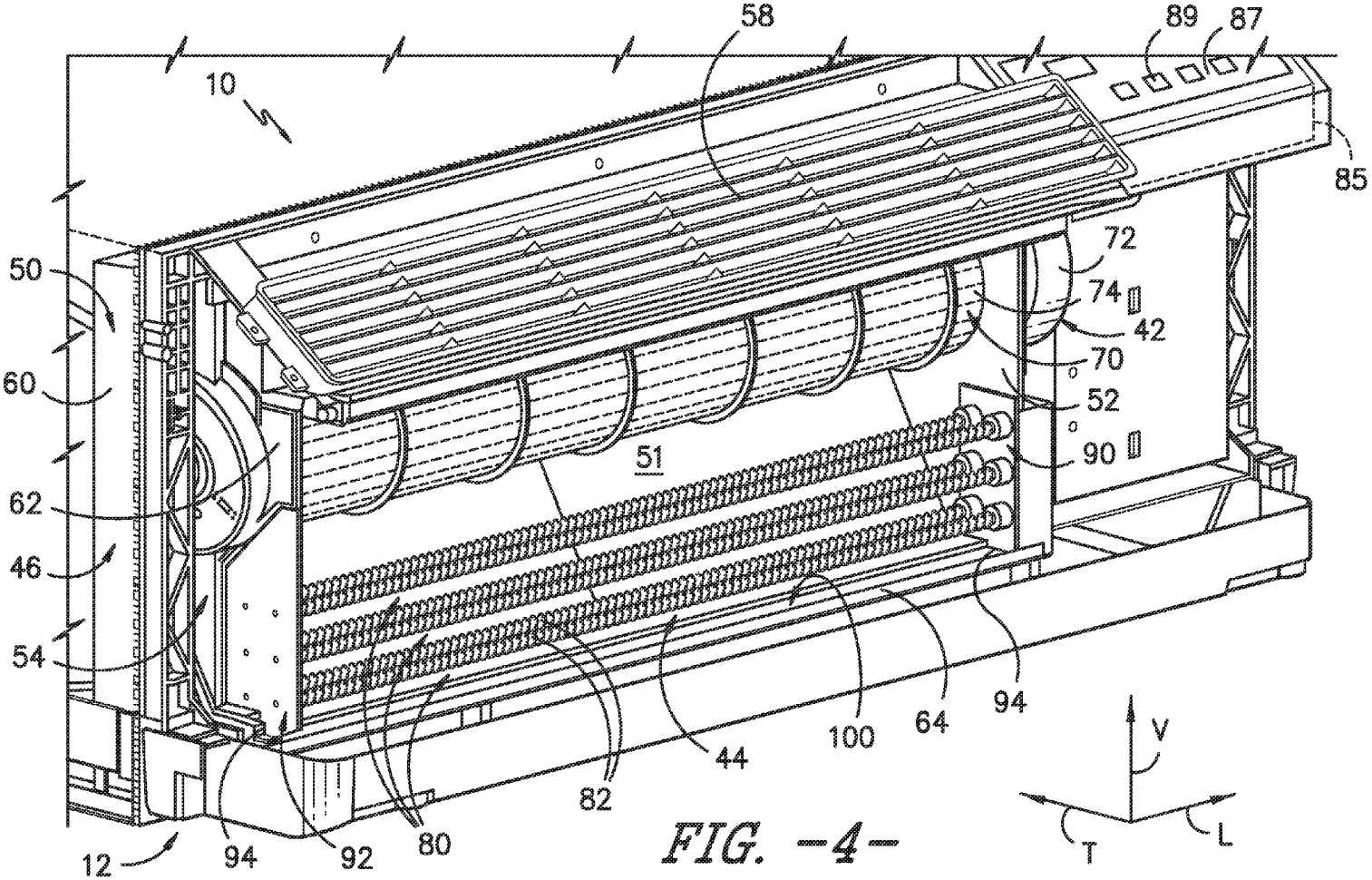
FIG. 4 is a perspective view of components of an indoor portion of an air conditioner unit, with a heating unit in an assembled position, in accordance with another embodiment of the present disclosure.
Figure 5:
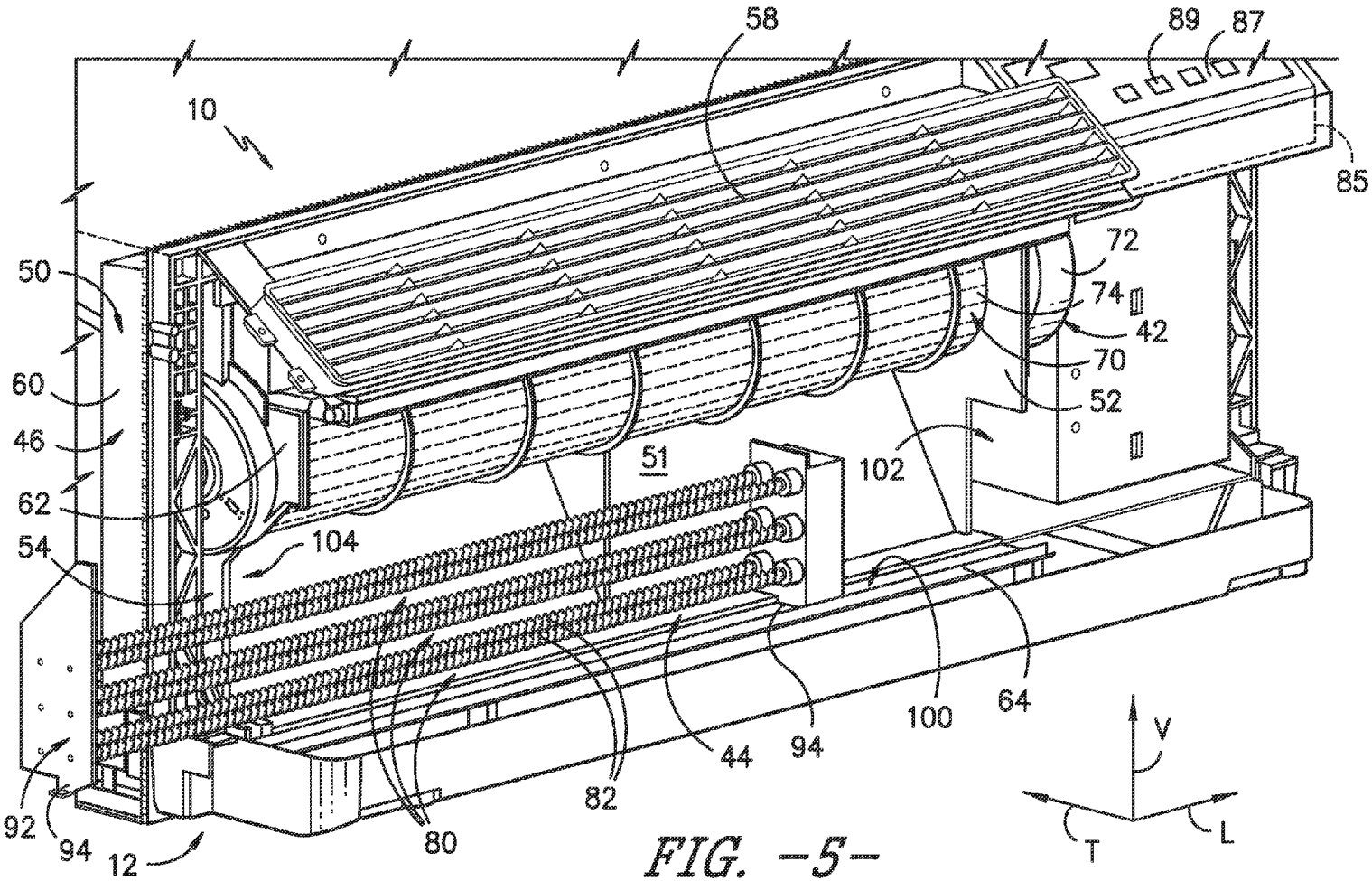
FIG. 5 is a perspective view of components of an indoor portion of an air conditioner unit, with a heating unit in a disassembled position, in accordance with another embodiment of the present disclosure.
Figure 6:
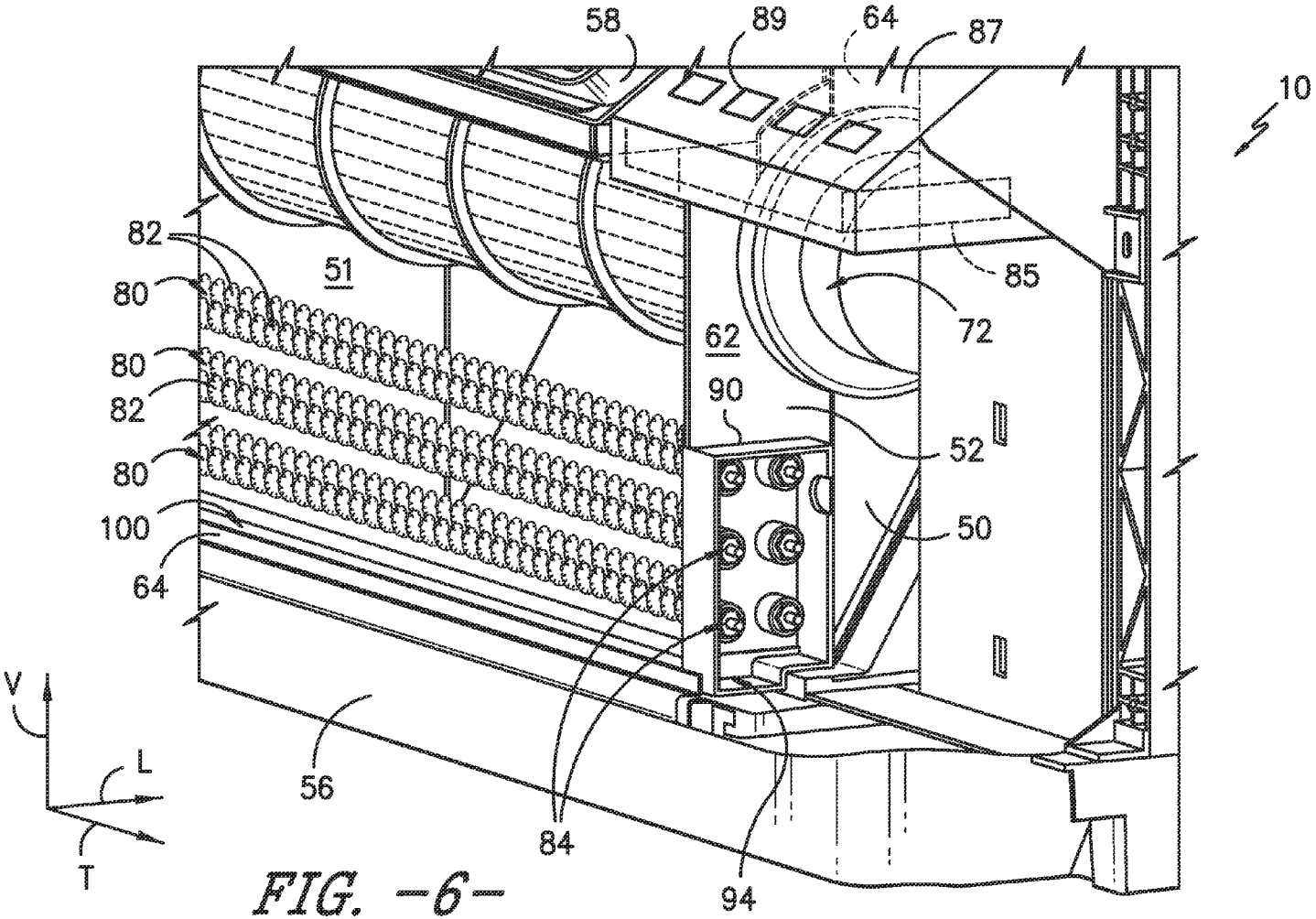
FIG. 6 is an opposing perspective view of components of an indoor portion of an air conditioner unit in accordance with one embodiment of the present disclosure.

As discussed, improved apparatus which facilitate easy and efficient removal and replacement of heating units 44 of air conditioner units 10 would be advantageous. Accordingly, as discussed herein, heating unit 44 may advantageously be movable along the lateral direction L, such as between an assembled position as illustrated in FIGS. 2, 4 and 6, and a disassembled position as illustrated in FIGS. 3 and 5. This eliminates the need to remove the heating unit 44 vertically, thus allowing the heating unit 44 to, for example, be generally vertically aligned with the blower fan 42 along the transverse direction T. Further, this reduces the number of components that must be disassembled in order to disassemble the heating unit 44 from the air conditioner unit 10, and increases the efficiency associated with assembly and disassembly of the heating unit 44 from the air conditioner unit.

Accordingly, heating unit 44 may further include a first bracket 90 and a second bracket 92. The first bracket 90 and second bracket 92 may (when in an assembled position) be spaced apart along the lateral direction L. Each heater bank 80 may extend along the lateral direction L (when in an assembled position) between the sidewalls 52, 54. The brackets 90, 92, along with the heater banks 80 therebetween, may be movable along the lateral direction.

For example, heating unit 44 in general may be movable along a guide track 100. The guide track 100 may, for example, be a separate component from the heater housing 46 that is provided within the interior 51, or may be integral with the heater housing 46, such as the bulkhead 60 or shroud 62 (as shown) thereof. Guide track 100 may extend along the lateral direction L between the first sidewall 52 and the second sidewall 54. As shown, components of the first bracket 90 and/or second bracket 92 may movably engage the guide track 100, such that the heating unit 44 is movable along the guide track 100 along the lateral direction L.

In some embodiments, as shown in FIGS. 2 and 3, the guide track 100 may for example be a rail that protrudes into the housing interior 51. For example, the rail may be an integral raised portion of the housing 46, such as the shroud 62 thereof. In some embodiments, for example, the rail may protrude from the interior shroud base 64 of the shroud 62. In other embodiments, as shown in FIGS. 4, 5 and 6, the guide track 100 may for example be a channel that is defined in the housing interior 51. For example, the rail may be an integral lowered portion of the housing 46, such as the shroud 62 thereof. In some embodiments, for example, the rail may be defined in the interior shroud base 64 of the shroud 62.

One or both of the first bracket 90 and second bracket 92 may further include a mating guide feature 94 that mates with and thus movably engages the guide track 100. For example, in some embodiments as shown in FIGS. 2 and 3, the mating guide feature 94 may be a groove that is defined in the bracket 90, 92. In particular, the groove may be sized and shaped to mate with the guide track 100 in embodiments wherein the guide track 100 is a rail. Thus, for example, the groove may slide along the rail when the heating unit 44 is moving along the guide track 100. In other embodiments as shown in FIGS. 4, 5 and 6, the mating guide feature 94 may be a tab that protrudes from the bracket 90, 92. In particular, the tab may be sized and shaped to mate with the guide track 100 in embodiments wherein the guide track 100 is a channel. Thus, for example, the tab may slide within the channel when the heating unit 44 is moving along the guide track 100.

As mentioned and as illustrated in FIGS. 2, 4 and 6, the heating unit 44 in exemplary embodiments is generally vertically aligned with the blower fan 42 along the transverse direction T when in an assembled position. The fan 42 may, for example, be mounted to the shroud 62 or housing 46 generally. Accordingly, a first cutout 102 and a second cutout 104 may be defined in the first sidewall 52 and the second sidewall 54, respectively. The cutouts 102, 104 may be generally vertically aligned with the blower fan 42 along the transverse direction. Portions of the heating unit 44 may be allowed to pass through the cutouts 102, 104 to facilitate movement of the heating unit 44 along the guide track 100, such as along the lateral direction L.

As discussed, the heating unit 44 is movable along the guide track 100, such as along the lateral direction L. FIGS. 2, 4 and 6 illustrate heating unit 44 in assembled positions. In this position in these embodiments, for example, the heater banks 80 are entirely disposed within the interior 51. FIGS. 3 and 5 illustrate heating unit 44 in disassembled positions. In this position in these embodiments, for example, at least a portion of the heater banks 80 are disposed exterior to the housing interior 51.

As is generally understood, the sidewalls 90, 92 in part define the housing interior 51 therebetween. Referring to FIG. 6, each heater bank 80 may include one or more heater bank terminals 84. For example, each coil 82 may include a terminal 84 which be disposed at one end of the coil 82. Each terminal 84 may be in electrical communication with a power source through, for example, suitable wiring (not shown), as is generally understood. In exemplary embodiments, each terminal 84 may further advantageously be disposed exterior to the heater housing 46 when the heating unit 44 is in an assembled position. As shown, for example, each terminal 84 may be disposed on an opposite side of a bracket, such as bracket 90, from the associated bank 80 and/or coil 82. Accordingly, when the heating unit 44 is in an assembled position, the terminals 84 may be exterior to the heater housing 46. In some exemplary embodiments, for example, terminals 84 may be generally vertically aligned with the fan motor 72 along the lateral direction L. The positioning of the terminals 84 exterior to the heater housing 46 advantageously eliminates cold spots associated with the terminals 84 during operation of the heating unit 44.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit that defines a vertical direction, a lateral direction, and a transverse direction that are each perpendicular to each other, the air conditioner unit comprising:

a heater housing having peripheral surfaces defining a housing interior, the peripheral surfaces comprising a first sidewall and a second sidewall, the first and second sidewalls spaced apart along the lateral direction;

a guide track extending along the lateral direction between the first sidewall and the second sidewall;

a blower fan, the blower fan comprising a blade assembly disposed within the interior and a motor connected to the blade assembly; and a heating unit comprising a first bracket and a second bracket, the first and second brackets spaced apart along the lateral direction, the heating unit further comprising at least one heater bank extending along the lateral direction between the first bracket and the second bracket, the first bracket and the second bracket defining a portion of the housing interior in an assembled position, wherein at least a portion of the heating unit, including the first bracket, is movable along the guide track in the lateral direction between the second sidewall and the first sidewall, and wherein the first sidewall is disposed exterior to a portion of the first bracket that is contacting the first sidewall and said contacting portion of the first bracket is disposed interior to the heater housing in the assembled position, said contacting portion being disposed opposite the guide track in the assembled position.

2. The air conditioner unit of claim 1, wherein the guide track is a rail protruding into the housing interior.

3. The air conditioner unit of claim 1, wherein the guide track is a channel.

4. The air conditioner unit of claim 1, wherein at least one of the first bracket and the second bracket comprises a mating guide feature matable with the guide track.

5. The air conditioner unit of claim 4, wherein the mating guide feature is a tab.

6. The air conditioner unit of claim 4, wherein the mating guide feature is a groove.

7. The air conditioner unit of claim 1, wherein the heater housing comprises a bulkhead and a shroud connected to the bulkhead, the bulkhead and shroud comprising the peripheral surfaces such that the bulkhead and the shroud define a portion of the housing interior.

8. The air conditioner unit of claim 1, wherein the heating unit is generally vertically aligned with the blower fan along the transverse direction when in the assembled position.

9. The air conditioner unit of claim 1, wherein the motor is disposed exterior to the heater housing.

10. The air conditioner unit of claim 9, wherein a heater bank terminal of the at least one heater bank is disposed exterior to the heater housing when the heating unit is in the assembled position.

11. The air conditioner unit of claim 1, wherein the heating unit is movable along the guide track between the assembled position wherein the at least one heater bank is entirely disposed within the housing interior and a disassembled position wherein at least a portion of the heater bank is disposed exterior to the housing interior.

12. The air conditioner unit of claim 1, wherein the at least one heater bank is three heater banks.

13. The air conditioner unit of claim 12, wherein each of the three heater banks comprises two heater coils.

14. The air conditioner unit of claim 13, wherein the heater coils of the heater banks are arranged in two columns and three rows.

15. An air conditioner unit that defines a vertical direction, a lateral direction, and a transverse direction that are each perpendicular to each other, the air conditioner unit comprising:

a heater housing having peripheral surfaces defining a housing interior, the peripheral surfaces comprising a first sidewall and a second sidewall, the first and second sidewalls spaced apart along the lateral direction, the heater housing comprising a bulkhead and a shroud connected to the bulkhead, the bulkhead and shroud comprising the peripheral surfaces such that the bulkhead and the shroud define a portion of the housing interior, the shroud further comprising an interior shroud base;

a guide track extending along the lateral direction between the first sidewall and the second sidewall;

a blower fan, the blower fan comprising a blade assembly disposed within the interior and a motor connected to the blade assembly; and a heating unit comprising a first bracket and a second bracket, the first and second brackets spaced apart along the lateral direction, at least one of the first bracket and the second bracket comprising a mating guide feature matable with the guide track, the heating unit further comprising a plurality of heater banks each extending along the lateral direction between the first bracket and the second bracket, the first bracket and the second bracket defining a portion of the housing interior in an assembled position, wherein at least a portion of the heating unit, including the first bracket, is movable along the guide track in the lateral direction between the second sidewall and the first sidewall, and wherein the first sidewall is disposed exterior to a portion of the first bracket that is contacting the first sidewall and said contacting portion of the first bracket is disposed interior to the heater housing in the assembled position, said contacting portion being disposed opposite the guide track in the assembled position.

16. The air conditioner unit of claim 15, wherein the guide track is a rail protruding from the interior shroud base into the housing interior.

17. The air conditioner unit of claim 15, wherein the guide track is a channel defined in the interior shroud base.

18. The air conditioner unit of claim 15, wherein the heating unit is generally vertically aligned with the blower fan along the transverse direction when in the assembled position.

19. The air conditioner unit of claim 15, wherein the motor is disposed exterior to the heater housing.

20. The air conditioner unit of claim 19, wherein a heater bank terminal of the at least one heater bank is disposed exterior to the heater housing when the heating unit is in the assembled position.

* * * * *